US006508704B1

(12) United States Patent
Wilson

(10) Patent No.: US 6,508,704 B1
(45) Date of Patent: Jan. 21, 2003

(54) AIR VENT APPARATUS FOR BLOCKING LIGHT

(75) Inventor: Clark Wilson, Clackamas, OR (US)

(73) Assignee: InFocus Systems, Inc., Wilsonville, OR (US)

( * ) Notice: Subject to any disclaimer, the term of this patent is extended or adjusted under 35 U.S.C. 154(b) by 59 days.

(21) Appl. No.: 09/607,572

(22) Filed: Jun. 29, 2000

(51) Int. Cl.[7] ..... F24F 7/00
(52) U.S. Cl. ..... 454/277; 454/905
(58) Field of Search ..... 454/277, 293, 454/294, 295, 905

(56) References Cited

U.S. PATENT DOCUMENTS

| | | | | | |
|---|---|---|---|---|---|
| 2,373,416 | A | * | 4/1945 | Renton | 454/277 |
| 3,217,631 | A | * | 11/1965 | Thompson | 454/277 |
| 3,285,156 | A | * | 11/1966 | Bohanon | 454/277 |
| 3,628,442 | A | * | 12/1971 | Nijhuis | 454/277 |
| 5,238,451 | A | * | 8/1993 | Wulf et al. | 454/282 |
| 5,601,485 | A | * | 2/1997 | Gigola | 454/277 |

* cited by examiner

*Primary Examiner*—Derek Boles

(74) *Attorney, Agent, or Firm*—Blakely Sokoloff Taylor & Zafman LLP

(57) ABSTRACT

An air vent apparatus for blocking light is provided for devices requiring a light source for generating light, such as a presentation projector, an arc lamp, a laser device and the like. The improved air vent apparatus employs a stacked chevron design to minimize the restriction of the flow of air through the air vent while blocking the escape of direct light. In one embodiment of the present invention, the stacked chevron is symmetrically disposed in the air vent housing of the device. In another embodiment of the present invention, the stacked chevron is asymmetrically disposed in the air vent housing so that a vane of the chevron extending towards the interior of the air vent is substantially perpendicular to the air vent housing and substantially parallel to the source of the flow of air. The use of a stacked chevron design allows the air vent in the device housing be constructed with vanes having a range of shallower angles than those of prior art vents so as to minimize the restriction of the flow of air through the vent, while at the same time blocking all or nearly all of the direct light emitted from the device's light source. Numerous variations in the length of the vanes of the chevron (i.e. the depth of the air vent), the vane angle, and the pitch (i.e. the distance between the stacked chevrons) may be employed to achieve a suitably optimal vent for a number of different devices, including presentation projectors, arc lamps, laser devices and the like.

5 Claims, 10 Drawing Sheets

AIR VENT APPARATUS FOR BLOCKING LIGHT

BACKGROUND OF THE INVENTION

1. Field of the Invention

The present invention relates generally to air vents for ventilating a device having a light source. More specifically, the present invention relates to an air vent that blocks direct light emitted from the light source without substantially restricting the flow of air through the vent.

2. Background Information

Devices requiring a light source for generating light, such as a projection display apparatus, an arc lamp, a laser device and the like, need to be ventilated to dissipate heat generated by the light while minimizing or preventing the escape of direct light emitted by the device. These types of devices are therefore typically equipped with an air vent.

The air vent permits the exchange of warm air from the interior of the device for cooler air exterior to the device. Projection display apparatuses in particular are often further equipped with fans to increase the air flow so as to accelerate the exchange of air. Thus it is important to provide air vents that do not restrict or impede the flow of air from the interior to the exterior of the device to allow for maximum ventilation.

The concurrent requirement of minimizing or preventing the escape of direct light from the device works against designing air vents that allow unrestricted air flow. For example, a typical prior art air vent for a projector uses louvers to create the openings that permit the flow of air into and out of the device's housing. If the louver angle and depth is too shallow then the air flow may be relatively unrestricted, but the vent will allow direct light to escape from the housing. This is especially undesirable for a presentation projector device, since the light will interfere with the darkening of the presentation room required for proper viewing of the projected presentation. Alternatively, if the louver angle is too steep or the depth of the louvers too deep (i.e. if the length of the vanes of the louver are too long), then the air flow is severely restricted. While this has the effect of blocking the escape of at least some of the direct light, it results in an undesirable increase in the amount of heat buildup from the light source or other heat emitting components in the interior of the device housing. FIGS. 1*a*–1*b* illustrate an example of the latter type of prior art projector air vent 100. The frontal view shows a series of parallel angled louvers 120 set into the projector housing and intermittently connected by vertical connecting ribs 105. As shown in a sectional view 110 of the prior art projector air vent, the steep angle 115 of the louvers 120 restricts the air flow, thereby impeding the air vent's ability to dissipate heat emitted by the light source 125. At the same time, some direct light can still escape 130, thus interfering with the proper viewing of the projected presentation.

Another drawback of prior art air vent designs is the reliance on increased fan speed to overcome the air flow restriction of vent designs that attempt to block direct light from escaping. This has the undesirable effect of increasing the noise produced by the device. In the context of a presentation projection device, the noise can interfere with the effective use of the device to deliver a presentation in a conference room setting.

The challenge of designing an air vent that blocks direct light from escaping from the device housing is fairly straightforward; the air vent must be constructed so as to interfere with all direct light paths regardless of the vantage point of the user of the device. On the other hand, the challenge of designing a vent that minimizes the restriction of air flow while blocking direct light requires a complex analysis of the causes of air flow restriction through the vent: flow between parallel plates (the flow along the surfaces of the parallel louvers that comprise the vent), flow contraction at the entrance to the vent, and changing the direction of the flow (the angle of the louvers measured from a perpendicular to the vent). As explained in the following paragraphs, the causes of air flow restriction are discussed in terms of the loss of air flow pressure from the time the flow of air enters the vent until the time the flow of air exits the vent.

The air flow pressure loss between the parallel louvers or substantially parallel louvers is attributed to the boundary layer phenomenon, whereby air particles on the inside walls of the louver surfaces are at zero velocity. An example of the boundary layer phenomenon is illustrated in FIG. 2. The zero velocity air particles 210 create a layer 215 that increases in thickness as the flow of air 220 moves through the parallel louvers 205. Eventually, the outer portion of the boundary layers 215 on the opposing interior surfaces 225 of the parallel louvers 205 contain air particles having a reduced flow air velocity that nearly converge 230 such that air no longer flows efficiently through the air vent 200. The pressure loss between the parallel louvers 205 scales linearly with the length 250 of the vanes of the parallel louvers 205 and inversely with the square of the distance between the louvers 240 (also referred to as the pitch of the vanes). The pressure loss also scales linearly with the velocity of the air flow 245 upon entering the air vent 200. So increasing the speed of a fan to increase the air flow velocity will only result in a proportionate increase in the pressure loss through the air vent 200. Consequently, the length of the vanes of the parallel louvers 250 as well as the distance between adjacent louvers 240 (the pitch) are important factors to consider when designing an air vent that minimizes the loss of air flow pressure.

The pressure loss due to the contraction of the air flow at the entrance to the vent is a function of the open area fraction, according to a classic reference on the subject, Kays, W. M, and London, A. L., *Compact Heat Exchangers,* 3rd Ed., McGraw-Hill, New York, 1984. An illustration of the entrance 315 to a set of parallel louvers 320 in a typical prior art air vent 310 is shown in FIG. 3. The open area fraction is roughly equal to the thickness of the solid louver material 325 divided by the distance between adjacent louvers 330 (pitch), not taking into account the reduction of the size of the entrance due to the support ribs (not shown). The air flow contraction pressure loss varies as the square of the air flow velocity.

The pressure loss due to the change in direction of the air flow, i.e. the angular deflection of the air flow caused by the angle of the louvers measured from a perpendicular to the air vent, scales as a polynomial function of the angle, according to a classic reference on the subject, Fried, E., and Idelchik, I. E., *Flow Resistance: A Design Guide for Engineers*, Hemisphere Publishing, New York. An illustration of air flow restriction 115 caused by the angular deflection of the flow is shown in the sectional view 110 of the prior art vent in FIG. 1*b*. As is illustrated in FIG. 4, a graph entitled Louver Pressure Loss Coefficient 410 shows the coefficient of pressure loss 415 as a function of the louver angle 420. As shown, the coefficient of pressure loss is only 5 when the louver angle is 40 degrees, but quickly increases to a coefficient of pressure loss of 20 when the louver angle is 60 degrees. As expected, the shallower angles will not restrict air flow as much as the steeper angles. However, shallower angles also will not block as much direct light as the steeper angles, an undesirable result.

Accordingly, a new approach is needed for venting devices that takes into account all of the factors that affect air flow pressure loss through the vent as well as the requirement of blocking the emission of direct light from the device from most, if not all, vantage points of the device user. An air vent design that takes into account all of these factors and requirements presents a unique set of challenges, requiring a new and novel solution.

SUMMARY

According to one aspect of the invention, an air vent apparatus is provided in which a stacked chevron design is employed to allow increased air flow while blocking the escape of direct light. In one embodiment of the present invention, the stacked chevron is symmetrically disposed in the vent housing. In another embodiment of the present invention, the stacked chevron is asymmetrically disposed in the air vent housing so that a vane of the chevron extending towards the interior of the vent is substantially perpendicular to the air vent housing and substantially parallel to the source of the flow of air. The use of a stacked chevron design allows the device housing be constructed with vanes having a range of shallower angles than those of prior art air vents so as to minimize the restriction of the flow of air through the air vent, while at the same time blocking all or nearly all of the direct light emitted from the device's light source. Numerous variations in the length of the vanes of the chevron (i.e. the depth of the vent), the vane angle, and the pitch (i.e. the distance between the stacked chevrons) may be employed to achieve a suitably optimal air vent for a number of different devices, including presentation projectors, arc lamps, laser devices and the like.

BRIEF DESCRIPTION OF DRAWINGS

The present invention will be described by way of exemplary embodiments, but not limitations, illustrated in the accompanying drawings in which like references denote similar elements, and in which.

DETAILED DESCRIPTION OF THE INVENTION

In the following description various aspects of the present invention, an air vent apparatus that blocks light, will be described. Specific details will be set forth in order to provide a thorough understanding of the present invention. However, it will be apparent to those skilled in the art that the present invention may be practiced with only some or all of the described aspects of the present invention, and with or without some or all of the specific details. In some instances, well known features may be omitted or simplified in order not to obscure the present invention. Lastly, repeated usage of the phrase "in one embodiment" does not necessarily refer to the same embodiment, although it may.

Figure 1A:
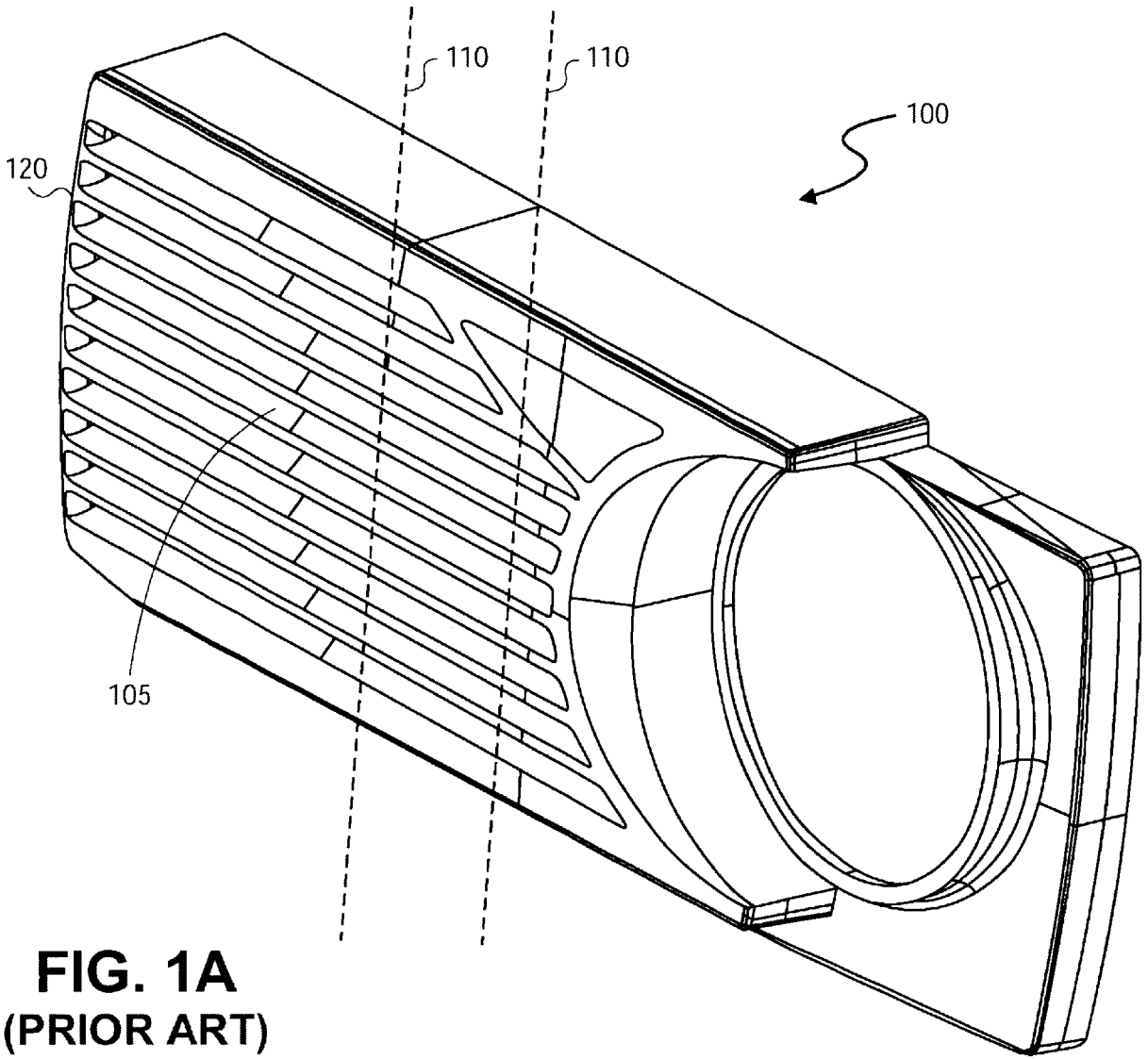
FIG. 1A (PRIOR ART)
FIG. 1*a* illustrates a frontal view of a prior art air vent used on a presentation projector.
Figure 1B:
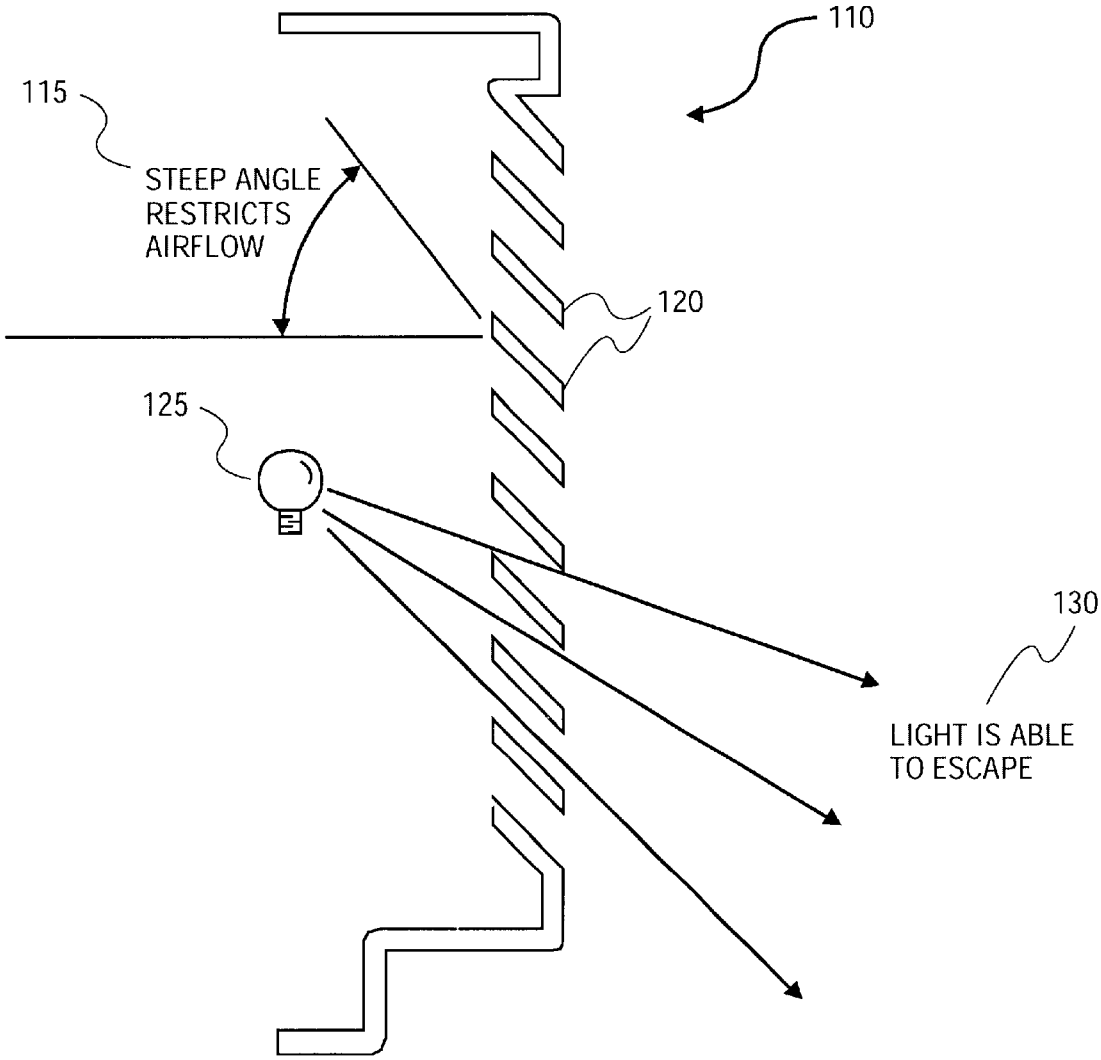
FIG. 1B (PRIOR ART)
FIG. 1*b* illustrates a sectional view of the prior art air vent shown in FIG. 1*a;*
Figure 2:
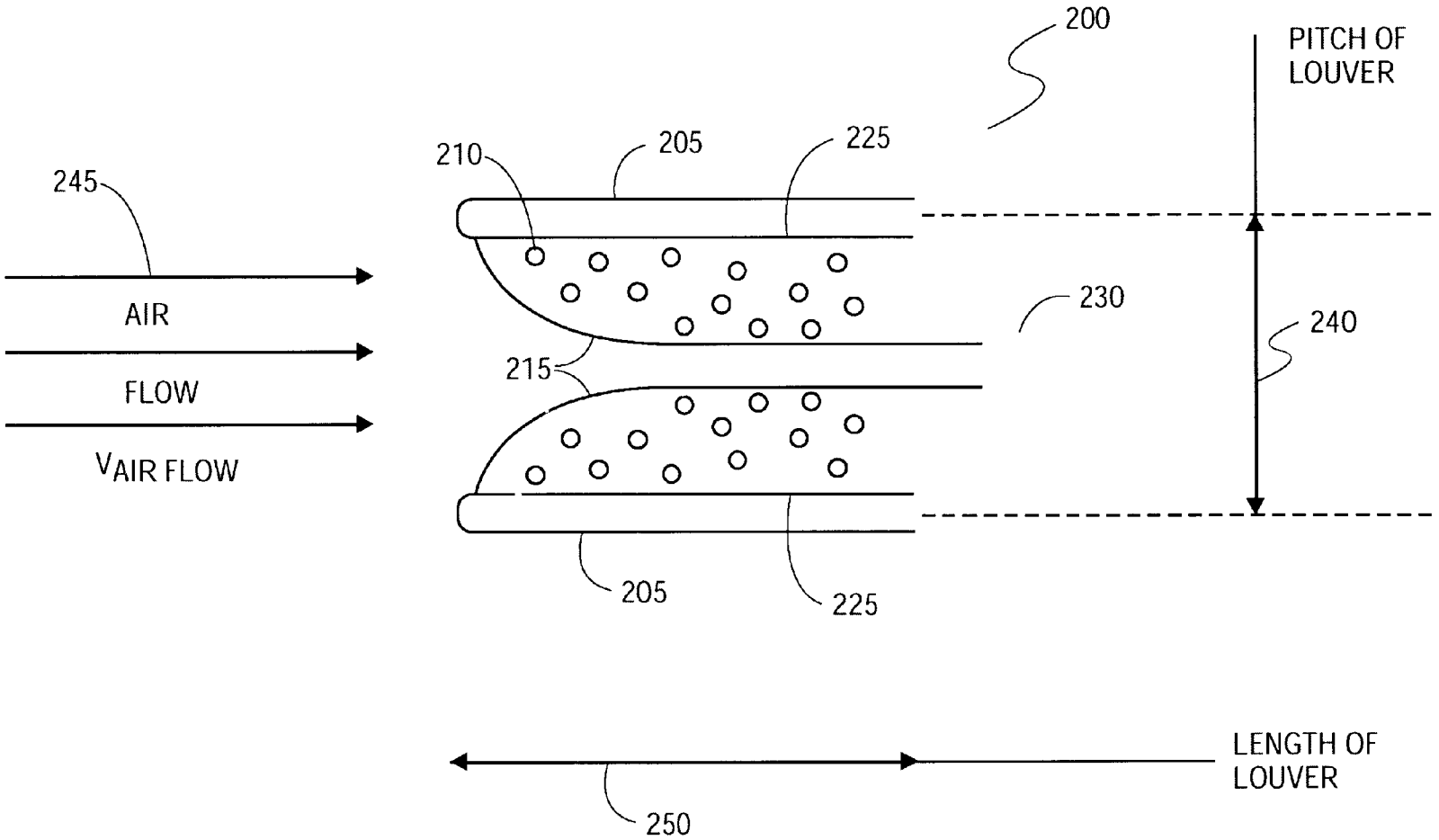
FIG. 2 illustrates an example of the boundary layer phenomenon.
Figure 3:
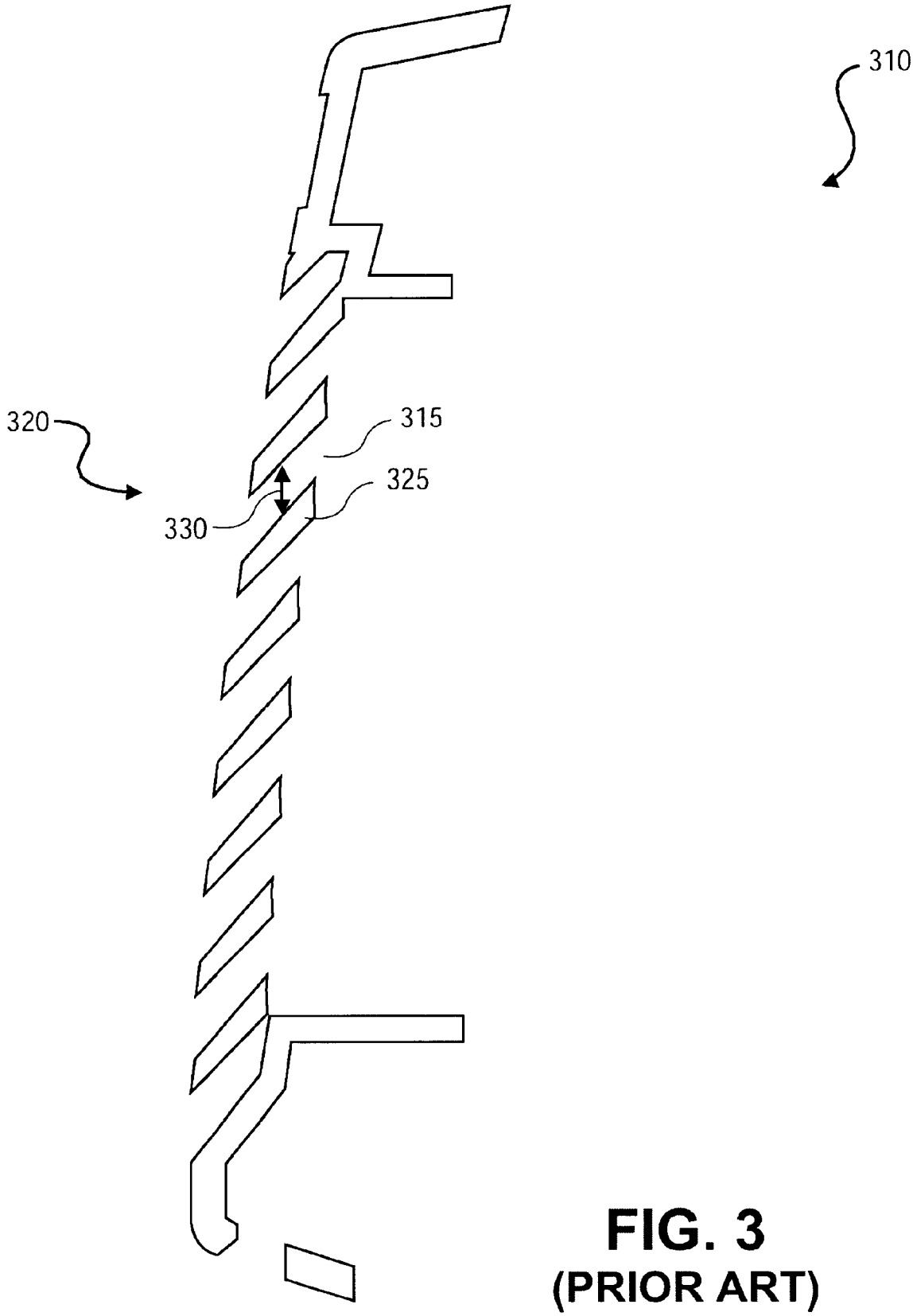
FIG. 3 (PRIOR ART)
FIG. 3 illustrates the entrance to a set of parallel louvers in a sectional view of a typical prior art air vent.
Figure 4:
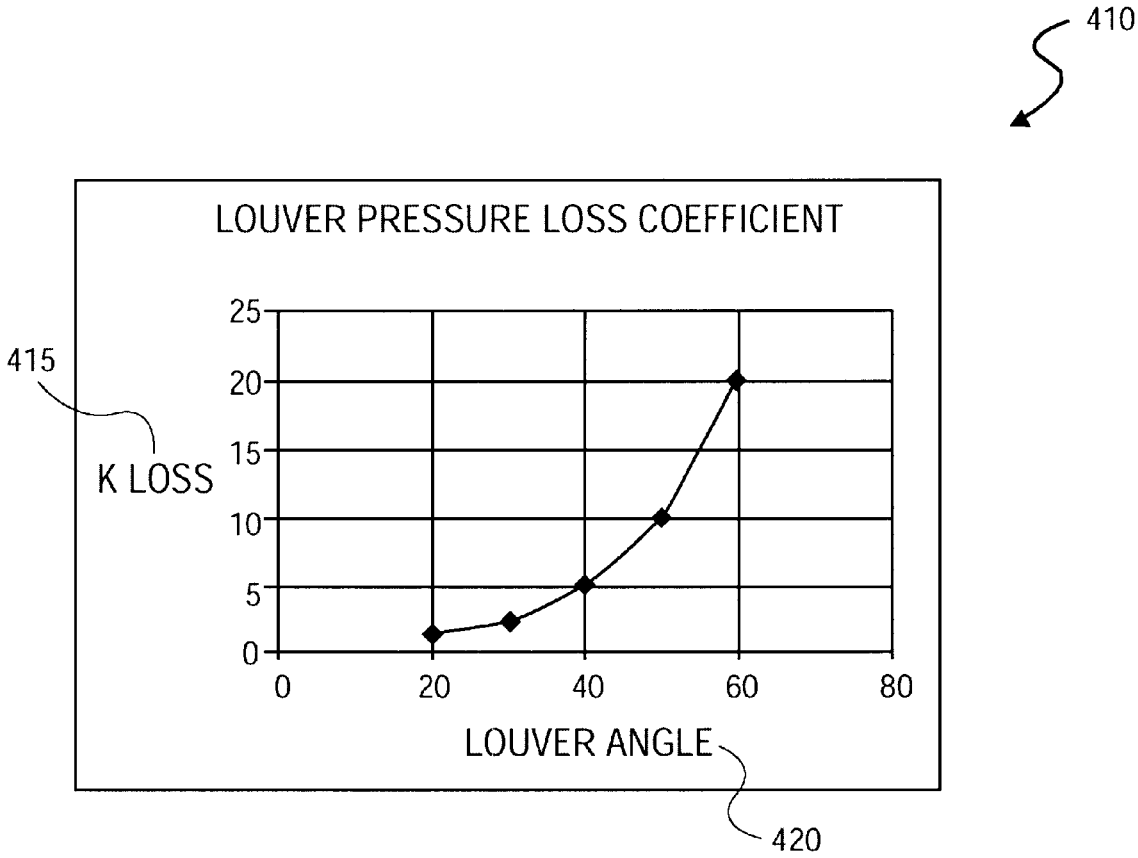
FIG. 4 illustrates a graph of the Louver Pressure Loss Coefficient for air flow restriction due to the angular deflection of the air flow by the louvers in a typical prior art air vent such as those shown in FIGS. 1*a*–1*b* and 3.
Figure 5A:
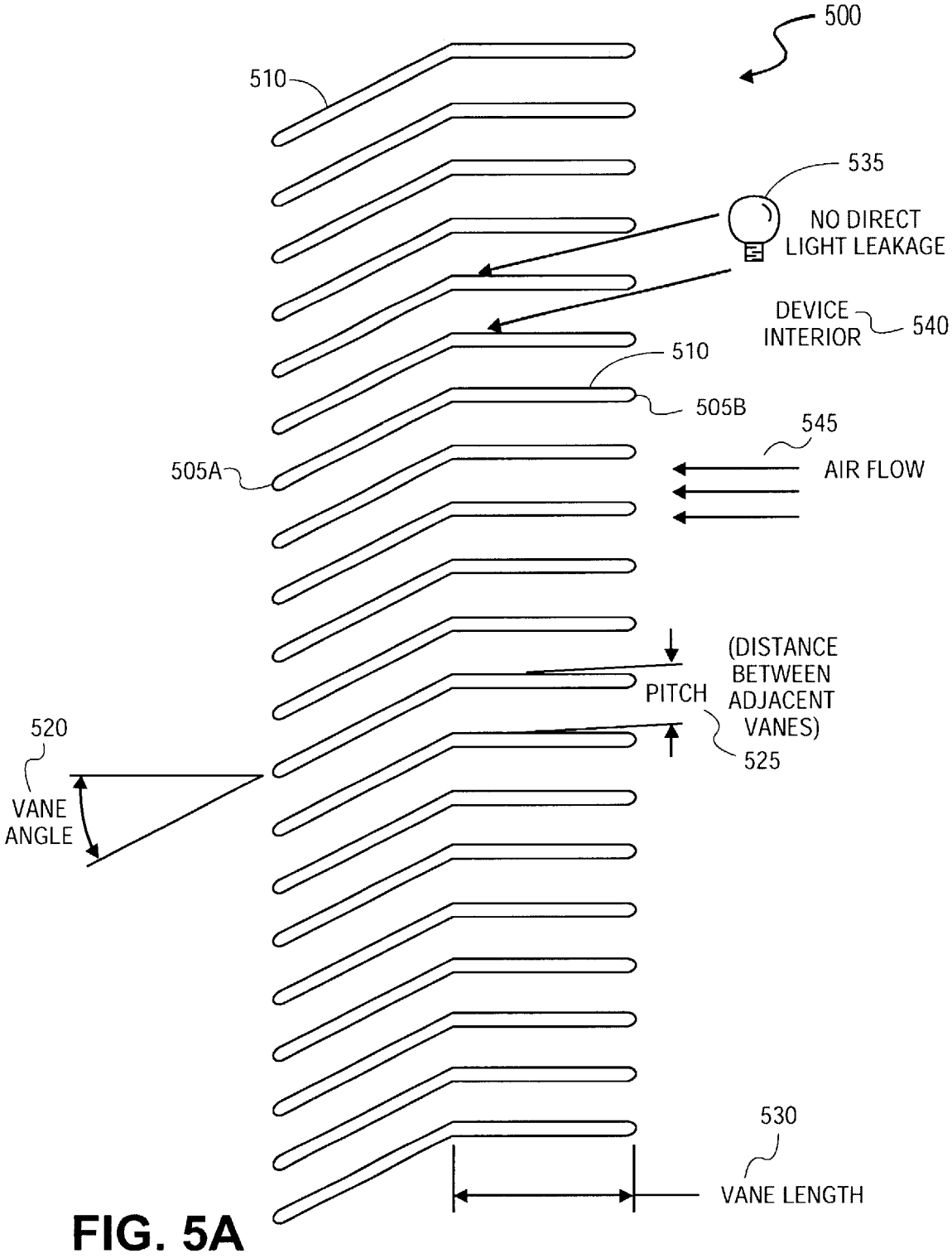
FIG. 5*a* illustrates a sectional view of an air vent apparatus that blocks light, in accordance with one embodiment of the present invention.

The frontal view of an air vent apparatus for blocking air in accordance with one embodiment would look very similar to the prior art air vent illustrated in FIG. 1*a*. However, a sectional view of an air vent apparatus for blocking air in accordance with one embodiment looks very different. Referring now to FIG. 5*a*, wherein a sectional view of the air vent apparatus 500 in accordance with one embodiment is shown in a manner analogous to that shown in FIG. 1*b*, section view 110. As illustrated in this sectional view of one embodiment of the present invention, the air vent 500 is composed of stacked angled vanes 505*a* and 505*b* made from a rigid material having a vane length 530 and formed in the shape of chevrons 510 that are asymmetrically disposed within the vent housing (not shown). The vane angle 520, measured from a perpendicular to the air vent, the vane pitch 525, and the vane length 530 are calibrated so that, as illustrated, there is no direct light leakage from the device light source 535. The vanes are connected to adjacent vanes with connecting ribs (not shown) similar to the connecting ribs shown in the prior art vent in FIG. 1*a*. The connecting ribs may be made of the same of different rigid material as the vanes. Preferably the material comprising the vanes and ribs has good heat dissipation characteristics, such as plastic or metal. In the embodiment, the stacked chevrons 510 are asymmetrically positioned such that the vane 505*b* extending into the interior of the device 540 is substantially perpendicular to the vent housing (not shown) and substantially parallel to the direction of the air flow 545.

Figure 5B:
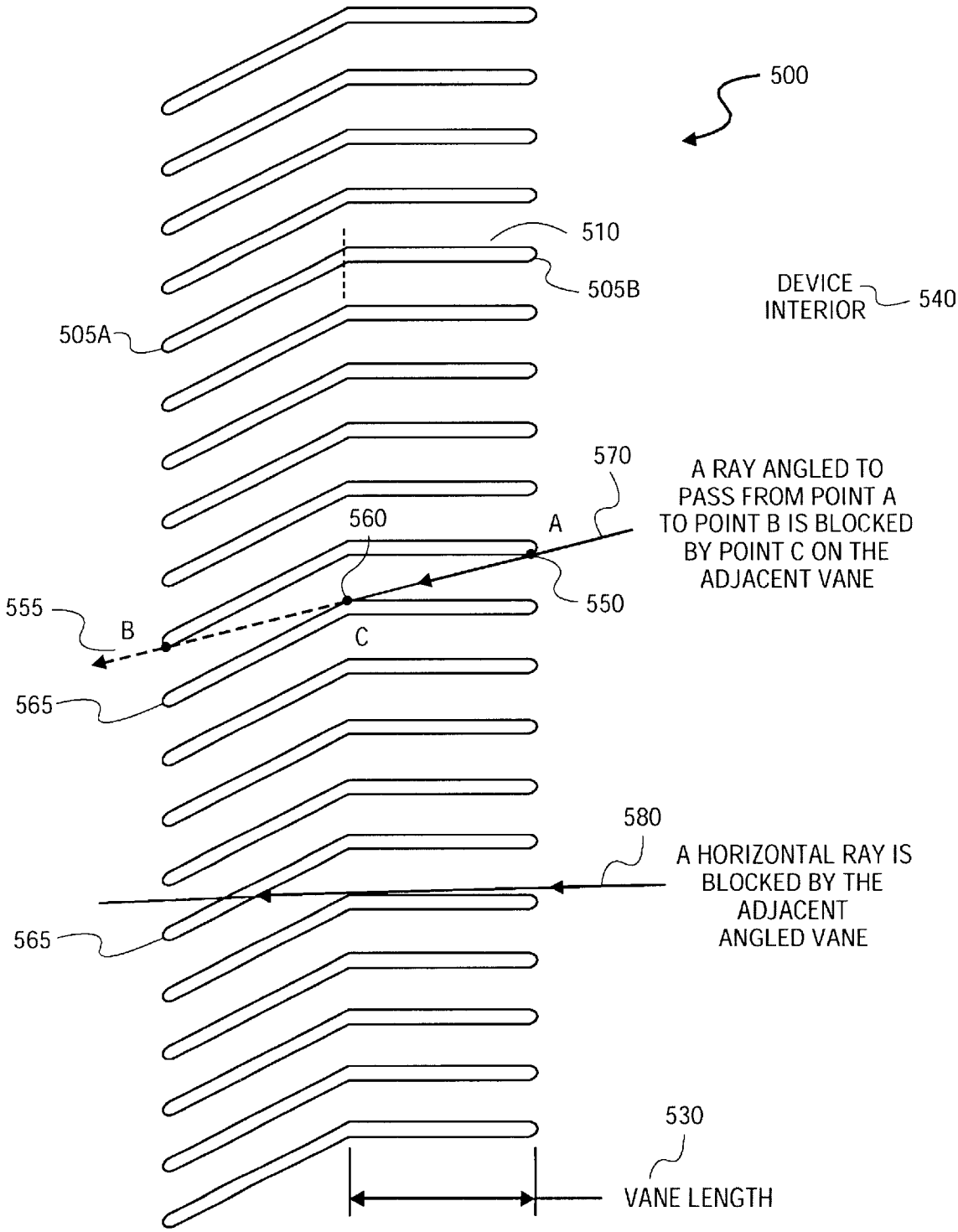
FIG. 5*b* further illustrates the conditions for light blockage in the air vent apparatus of FIG. 5*a;*

Referring now to FIG. 5*b*, wherein the same sectional view of the air vent apparatus 500 in accordance with the embodiment illustrated in FIG. 5*a*, which further illustrates the conditions for light blockage in more detail. First, three points on the vent, point A 550, point B 555, and point C 560 illustrate that a light ray 570 entering the opening created by the interior vane 540 of the vent 500 at point A 550 will be blocked by the point C 560 on the adjacent vane 565, thereby blocking the ray from exiting the vent 500 at point B 555. Moreover, a horizontal ray 580 is also illustrated as blocked from exiting the vent 500 by the portion of the adjacent vane 565 that extends into the exterior of the vent 500. As can be seen, direct rays of light 570 and 580 emitted from the light source in different directions are all blocked from escaping the air vent 500.

Figure 6A:
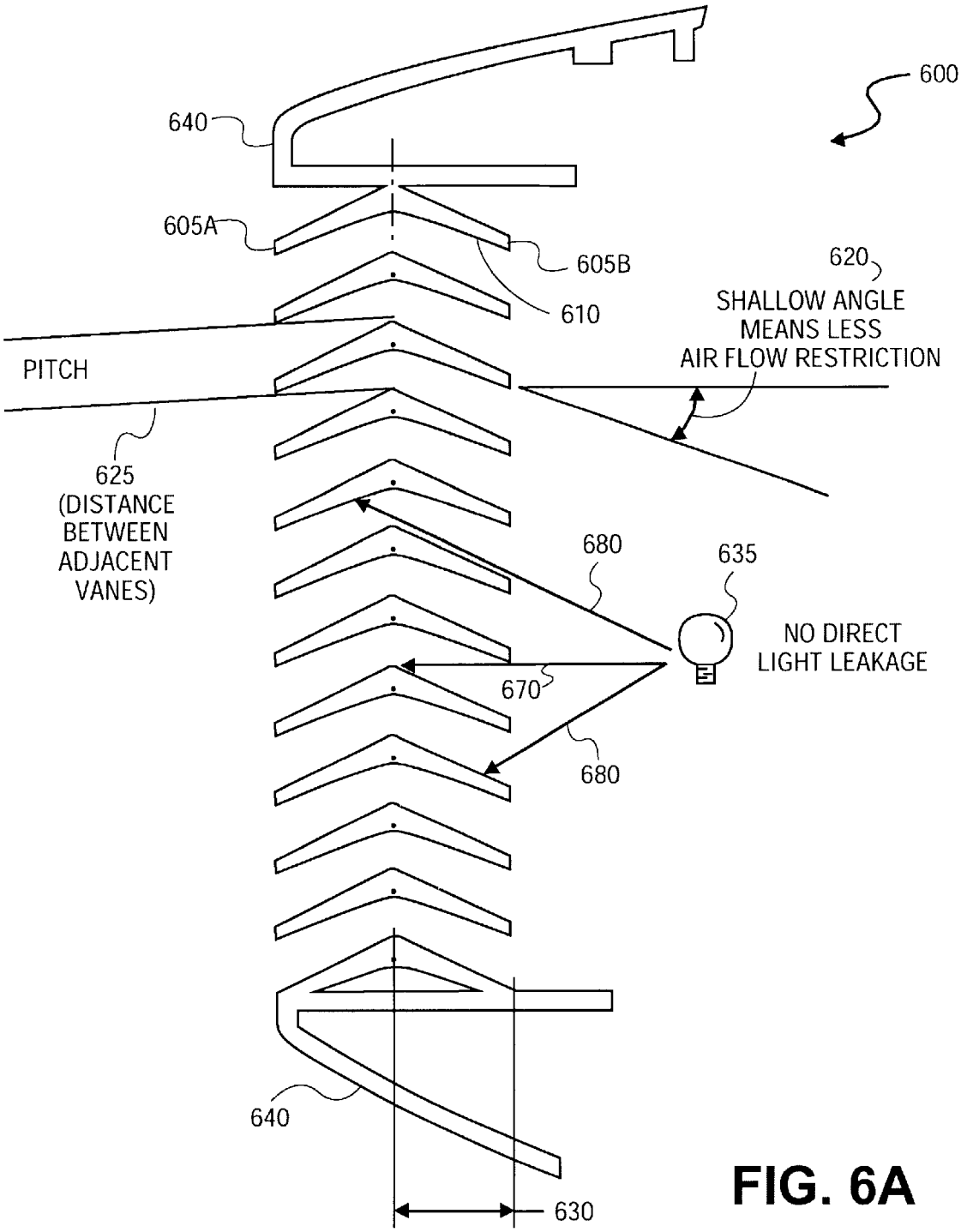
FIG. 6*a* illustrates a sectional view of an air vent apparatus that blocks light, in accordance with another embodiment of the present invention.

Referring now to FIG. 6*a*, wherein a sectional view of the air vent apparatus 600 in accordance with another embodiment is shown. As illustrated, the air vent 600 is composed of stacked angled vanes 605*a* and 605*b* made of a rigid material having a vane length 630 also formed in the shape of chevrons 610, except in this case they are symmetrically disposed within the vent housing 640. The vane angle 620, measured from a perpendicular to the air vent, the vane pitch 625, and the vane length 630 are calibrated so that, as illustrated, there is no direct light leakage from the device light source 635 from either light rays entering the vent at an angle 680, or light rays entering the vent perpendicularly 670 to the vent housing 640 (i.e. horizontal rays 670). As before, the vanes are connected to adjacent vanes with connecting ribs (not shown) made of either the same or different rigid material.

Figure 6B:
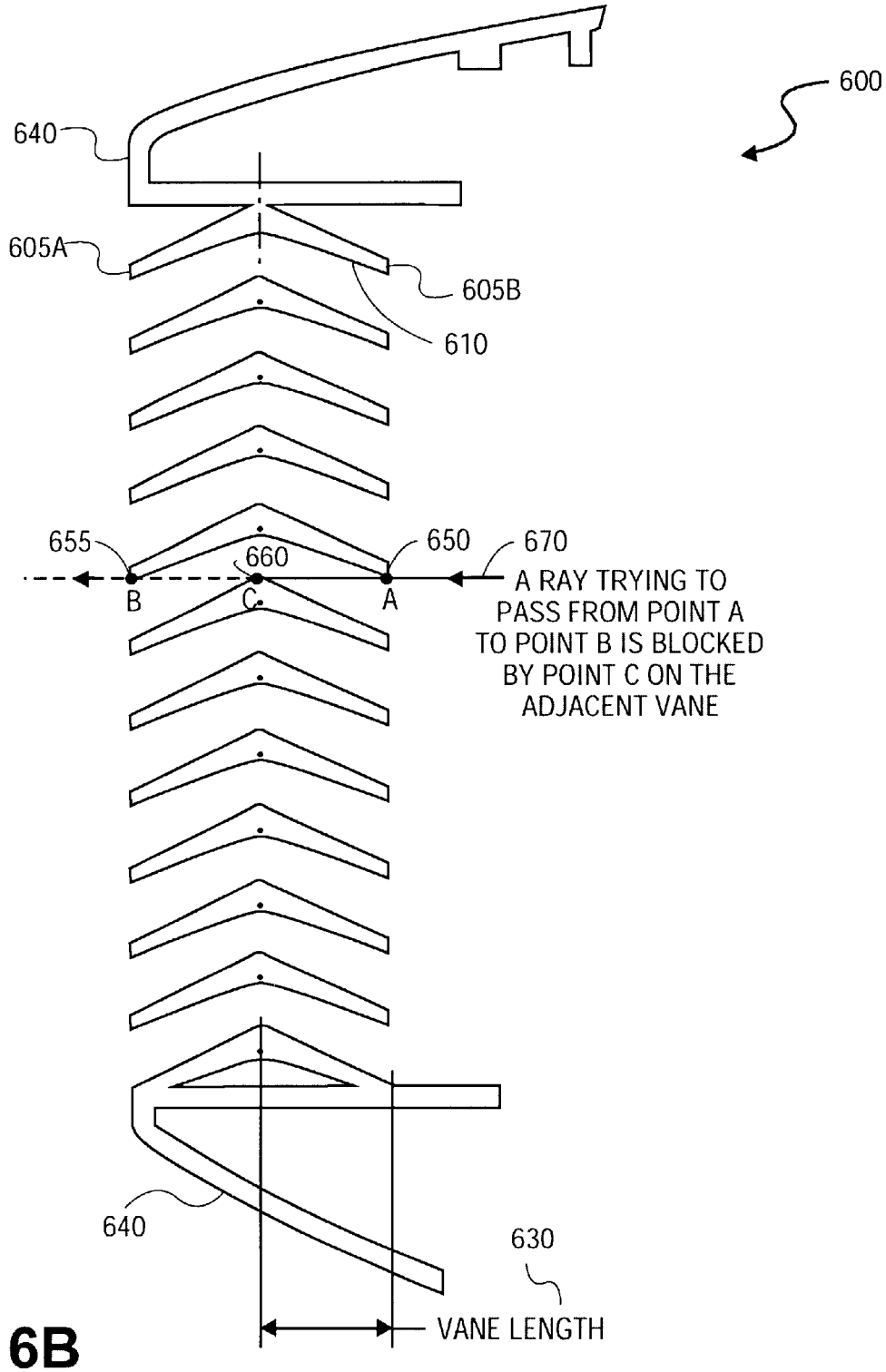
FIG. 6*b* further illustrates the conditions for light blockage in the air vent apparatus of FIG. 6*a;*

Referring now to FIG. 6*b*, wherein the same sectional view of the air vent apparatus 600 in accordance with the embodiment illustrated in FIG. 6*a*, which further illustrates the conditions for light blockage in more detail. First, three points on the vent, point A 650, point B 655, and point C 660 illustrate that a horizontal light ray 670 entering the opening created by the interior vane 645 of the vent 600 at point A 650 will be blocked by the point C 660 on the adjacent vane 665, thereby blocking the ray from exiting the vent 600 at point B 655. As can be seen in FIGS. 6*a*–6*b*, direct rays of light 670 and 680 emitted from the light source in different directions are all blocked from escaping the air vent 600 when both vanes are at an angle.

Depending on the specific requirements of the device for which the vent is designed, variations in the angle of the vanes, the length of the vanes and the pitch of the vanes may be employed without departing from the principles of the invention. For example, the chevrons may be asymmetrically disposed such that neither vane of the chevron is perpendicular to the vent housing. Or, the chevrons may be comprised of vanes that have a certain length on one side of the vent, and another length on another side of the vent. Although the pitch of the vanes is typically constant within a given vent, gradations in the pitch may also be accommodated, with corresponding gradations in the length and angle of the vanes.

EXAMPLE EMBODIMENT

Figure 7:
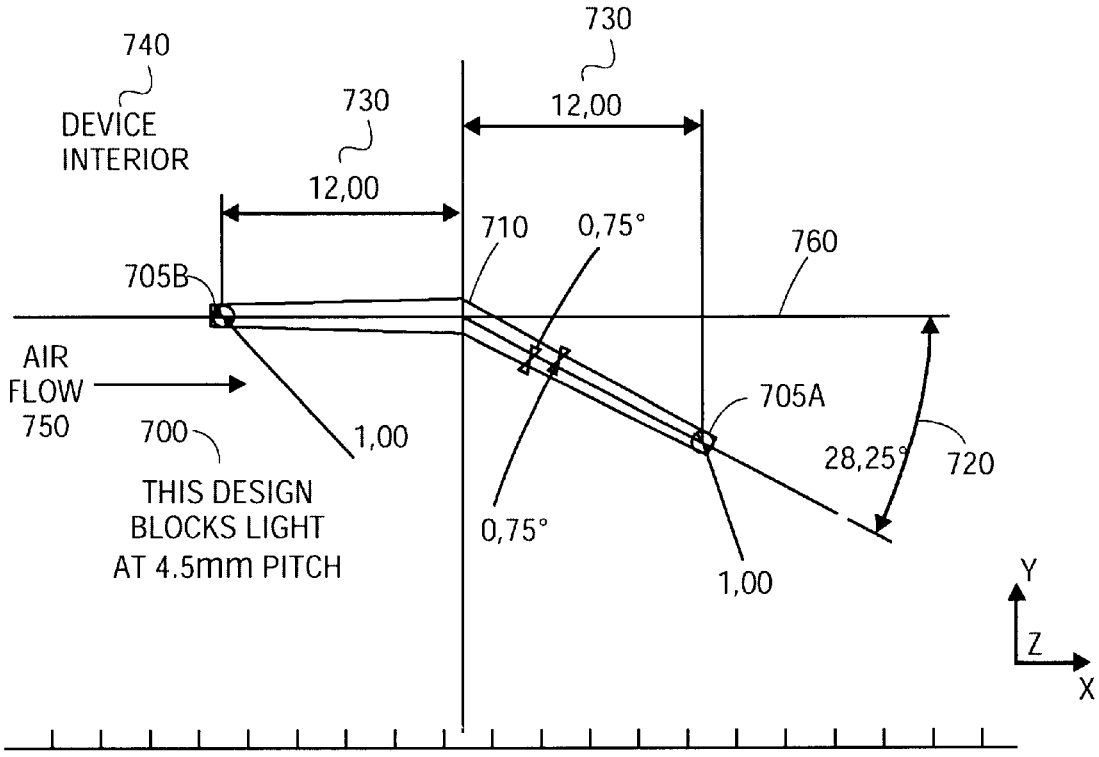
FIG. 7 illustrates a specific example of a vane design for an air vent that blocks light at a 4.5 mm pitch, in accordance with one embodiment of the present invention.

Referring now to FIG. 7, wherein an example of one embodiment of an air vent 700 that blocks light using a pitch size of 4.5 mm is illustrated. A single chevron 710 having vanes 705*a* and 705*b* is disposed asymmetrically within the vent housing (not shown) such that the vane 705*b* extending towards the device's interior 740 is substantially perpendicular to the vent housing (not shown) and substantially parallel to the direction of the flow of air 750. At a vane length of 12 mm 730 an optimal vane angle of 28.25 degrees 720 is employed to block direct light while at the same time substantially minimizing the restriction of the air flow 750 through the vent 700. The vane angle is measured from a perpendicular 760 to the vent housing (not shown).

Depending on the requirements of the device, variations in the vane length 730 and vane angle 720 for a given pitch of 4.5 mm may be employed. A table illustrating the range of optimal vane lengths 730 and vane angles 720 is illustrated in Table 1 below.

TABLE 1

| 4.5 mm vane-to-vane pitch | |
|---|---|
| Vane Length (millimeters) | Vane Angle (degrees) |
| 9 mm | 35.25° |
| 10 mm | 32.75° |

TABLE 1-continued

| 4.5 mm vane-to-vane pitch | |
|---|---|
| Vane Length (millimeters) | Vane Angle (degrees) |
| 11 mm | 30.25° |
| 12 mm | 28.25° |
| 13 mm | 26.75° |
| 14 mm | 24.75° |

It should be noted that, depending on the requirements of a given device, variations in the pitch may be employed, with corresponding variations in the optimal angle and length of the vanes, without departing from the principles of the invention. In addition the vanes of the chevron may be disposed symmetrically or asymmetrically in the vent housing, without departing from the principles of the invention. Although the illustrated embodiment shows the vanes of the chevron having an equal length, vanes of unequal length may be just as readily employed without departing from the principles of the invention.

Accordingly, a novel method and apparatus is described for an air vent apparatus for a device that blocks all or nearly all direct light emitted from a light source within the device while substantially minimizing the restriction of air flow through the air vent. From the foregoing description, those skilled in the art will recognize that many other variations of the present invention are possible. Thus, the present invention is not limited by the details described. Instead, the present invention can be practiced with modifications and alterations within the spirit and scope of the appended claims.

What is claimed is:

1. A vent for a device having a light source comprising:

a first vane connected to an adjacent vane, said vanes disposed in a vent housing of a device having a light source, said vanes having an angle, a length and a pitch for optimally forming an opening of the vent through which a minimally restricted flow of air is permitted to dissipate heat generated by the light source while said vanes block the path of a ray of direct light from the device light source from an interior side of the vent housing facing the device light source to an exterior side of the vent housing opposite to the interior side.

2. The vent of claim 1 wherein optimally forming an opening is achieved when the angle and length of said vanes are in proportion to the pitch so that a drop in a pressure of the flow of air upon exiting the opening is substantially minimized.

3. The vent of claim 1 wherein optimally forming an opening is achieved when said vanes are oriented substantially parallel to a direction of the flow of air to minimize a contraction of the flow of air as it enters said opening.

4. The vent of claim 1 wherein said vanes are disposed perpendicular to the interior side of the vent housing.

5. The vent of claim 1 wherein optimally forming an opening is achieved when the angle of said vanes measured from the perpendicular to the vent housing is substantially from 35.25 to 24.75 degrees, the length of said vanes is substantially from 9 millimeters to 14 millimeters, and the pitch between said vanes is substantially 4.5 millimeters.

* * * * *